US005975688A

United States Patent [19]

Kanaya et al.

[11] Patent Number: 5,975,688

[45] Date of Patent: Nov. 2, 1999

[54] INK CARTRIDGE FOR PRINTER AND INK CARTRIDGE IDENTIFYING APPARATUS

[75] Inventors: Munehide Kanaya; Takao Kobayashi; Hisashi Miyazawa; Eiko Yanagida; Kazuo Koshino, all of Nagano, Japan

[73] Assignee: Seiko Epson Corporation, Tokyo, Japan

[21] Appl. No.: 08/681,685

[22] Filed: Jul. 29, 1996

[30] Foreign Application Priority Data

Jul. 29, 1995 [JP] Japan ..... 7-212762

[51] Int. Cl.[6] ..... B41J 2/175

[52] U.S. Cl. ..... 347/86

[58] Field of Search ..... 347/86, 49, 50; 399/27, 119; 220/23.87, 23.89

[56] References Cited

U.S. PATENT DOCUMENTS

| | | | |
|---|---|---|---|
| 4,635,080 | 1/1987 | Watanabe | 347/50 |
| 4,803,521 | 2/1989 | Honda | 399/12 |
| 4,853,708 | 8/1989 | Walters | 347/86 |
| 5,406,320 | 4/1995 | Durst et al. | 347/86 |
| 5,411,343 | 5/1995 | Childers | 400/692 |
| 5,519,422 | 5/1996 | Thoman et al. | 347/49 |
| 5,530,531 | 6/1996 | Girard | 399/120 |

FOREIGN PATENT DOCUMENTS

| | | |
|---|---|---|
| 0 395 197 A1 | 10/1990 | European Pat. Off. . |
| 0 412 459 A2 | 2/1991 | European Pat. Off. . |
| 0 418 817 A1 | 3/1991 | European Pat. Off. . |
| 0 440 261 A2 | 8/1991 | European Pat. Off. . |
| 0 478 318 A2 | 4/1992 | European Pat. Off. . |
| 0 623 471 A2 | 11/1994 | European Pat. Off. . |
| 6-344628 | 12/1994 | Japan . |

*Primary Examiner*—N. Le
*Assistant Examiner*—Michael Nghiem
*Attorney, Agent, or Firm*—Stroock & Stroock & Lavan LLP

[57] ABSTRACT

An ink cartridge and an ink cartridge identifying apparatus are provided which reliably allow only standard, proper ink cartridges to be loaded. An ink cartridge to be loaded into a printer is provided which has a predetermined projected and recessed pattern portion formed on an outer surface thereof and which has a first electrode portion arranged on the projected and recessed pattern portion. The first electrode portion is positioned to be selectively engageable with a second electrode portion, which is arranged on a pattern matching portion which is fixed to a press rod arranged on the printer main body. First and second electrode portions are arranged on the projected and recessed pattern portion and the pattern matching portion to be selectively engageable, and an identification signal is generated when matching first and second electrode portions are engaged. The projected and recessed pattern portion and the pattern matching portion may be shaped into characters/symbols, graphics, or the like.

12 Claims, 7 Drawing Sheets

FIG. 2
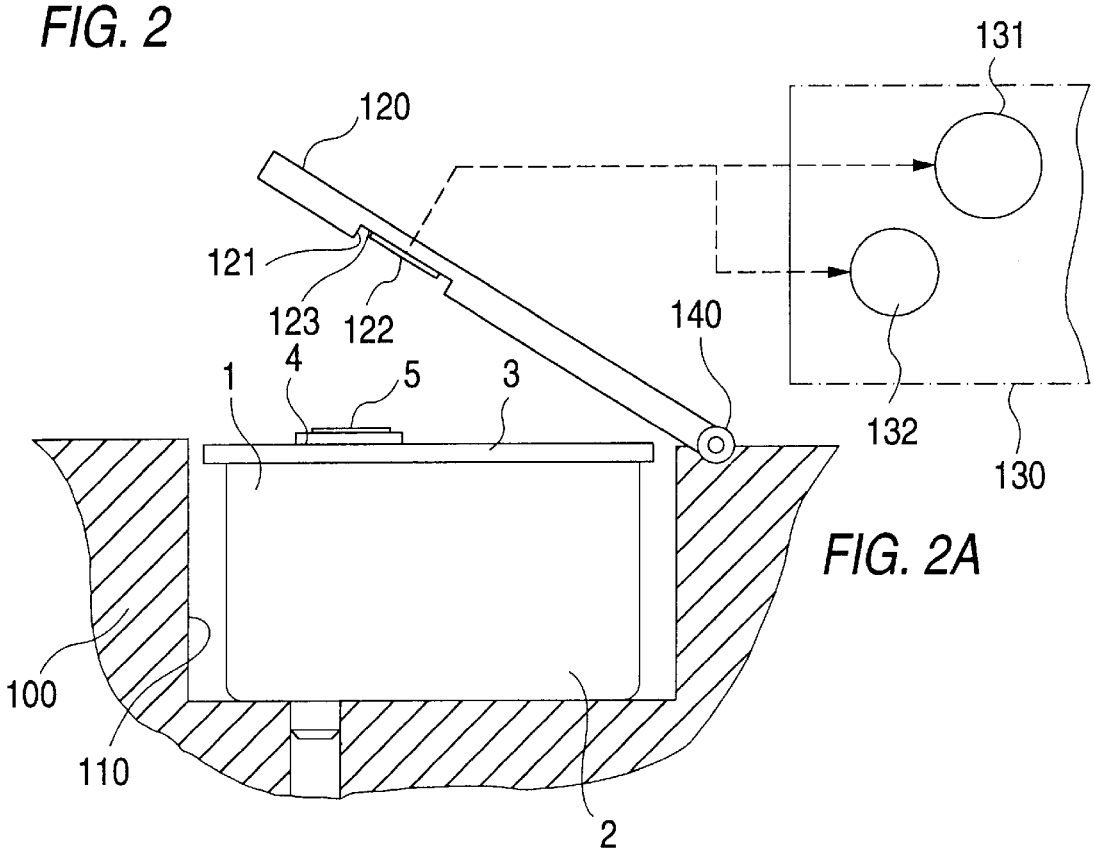
FIG. 2A
FIG. 3
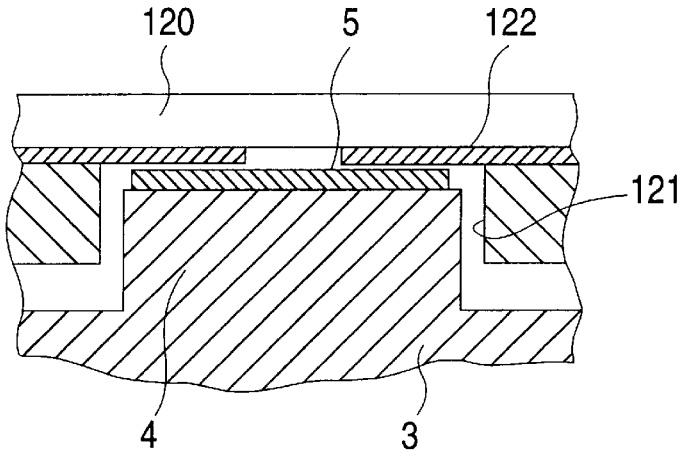

FIG. 5 (a)
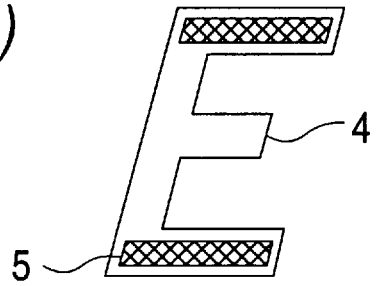
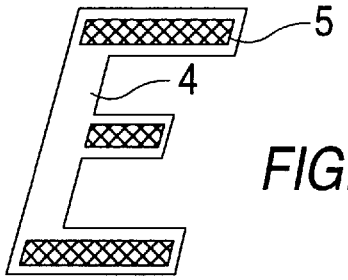
FIG. 5 (b)
FIG. 5 (c)
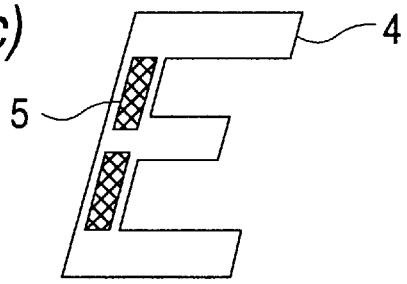
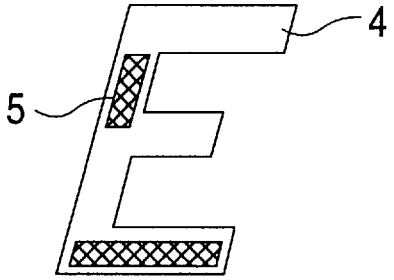
FIG. 5 (d)

INK CARTRIDGE FOR PRINTER AND INK CARTRIDGE IDENTIFYING APPARATUS

BACKGROUND OF THE INVENTION

This invention pertains to printer technology for a recording apparatus using an ink, such as ink jet printers and more particularly, to an ink cartridge and an ink cartridge identifying apparatus which can confirm that a standard, proper ink cartridge designed to be used for such a particular printer has been loaded into the printer.

If a wrong sized or shaped cartridge is forced into a printer, damage to both the cartridge and printer may occur. Additionally, print quality may suffer once the cartridge is inserted. In prior art printers, various systems have been utilized to avoid the breaking of a printer main body by the insertion of a print cartridge other than a print cartridge designed for use with the particular printer.

One example of such a prior art printer is disclosed in Unexamined Japanese Patent Publication No. Hei. 6-344628. In this prior art printer, first-level lockout processing is performed by first determining the number and position of a plurality of pen groups situated on the ink cartridge. A wing is arranged at a different position on each pen group by changing the dimension of a barrier arranged on the bottom of the carriage compartment of each pen group. Therefore, this barrier insures that a cartridge that is not one of a predetermined number of cartridges cannot be loaded into the printer since the pen groups will not move past the barrier and therefore the print operation cannot be performed.

Although the aforementioned prior art has been sufficient to prevent irregular loading of improper ink cartridges, there still is room for further improvement. It is desirable to provide a system with a simple structure and easy handling design which reliably allows for visibly checking and preventing the loading of an ink cartridge which is not one of a predetermined number of cartridges designed to be used with a particular printer.

SUMMARY OF THE INVENTION

Generally speaking, in accordance with the invention, a system for reliably visibly checking and preventing the loading of an ink cartridge which is not one of a predetermined number of cartridges design for a particular printer is provided. An ink cartridge identification system is provided having a printer main body, a first recessed and projecting portion fixed to the printer main body and a first electrode portion fixed to the first recessed and projecting portion. An ink cartridge dimensioned to be selectively loaded into said printer main body is also provided and has a second recessed and projecting portion fixed to it. The second recessed and projecting portion is selectively engageable with the first recessed and projecting portion. A second electrode portion is fixed to the second recessed and projecting portion. The second electrode portion is selectively engageable with the first electrode portion. The printer is operable when the first and said second recessed and projecting portions and the first and second electrode portions are engaged. A display lamp operatively coupled to one of the first and second electrode portions is illuminated when the printer is operable. The first and second recessed and projecting portions and the first and second electrode portions are engageable only when the ink cartridge is a standard, proper ink cartridge. Additionally, the ink cartridge is identified as being a standard, proper ink cartridge when the first and second recessed and projecting portions and the first and second electrode portions are properly engaged. The first recessed and projecting portions may be formed as characters, symbols, graphics or the like.

In a second embodiment, an ink cartridge identification system is provided comprising a printer main body and a first electrode portion fixed to printer main body. An ink cartridge dimensioned to be selectively loaded into the printer main body also provided, and a second electrode portion is fixed to the ink cartridge. The second electrode portion is selectively engageable with the first electrode portion. The ink cartridge is identified as being a proper, standard ink cartridge when the first and second electrode portions are engaged.

An ink cartridge dimensioned to be loaded into a printer main body is also provided. The ink cartridge is formed with a predetermined projected and recessed pattern portion on an outer surface thereof. A first electrode portion is arranged on the projected and recessed portion. The first electrode portion is able to come into contact with a second electrode portion fixed to a pattern matching portion, which is arranged on the printer main body which receives the ink cartridge. When the ink cartridge is loaded into the printer main body, the first and second recessed and projecting portions engage one another.

An ink cartridge dimensioned to be loaded into a printer main body may also be provided having a predetermined projected and recessed pattern portion fixed on an outer surface of the ink cartridge. A pattern matching portion is formed on a printer main body, which is dimensioned to receive the ink cartridge. The pattern matching portion is able to match and engage the projected and recessed pattern portion. The projected and recessed pattern portion and the pattern matching portion may be formed as a pattern corresponding to at least one of characters, symbols and graphics.

Accordingly, it is an object of the invention to provide an ink cartridge and an ink cartridge identifying apparatus which are devised to safely and reliably allow only ink cartridges appropriate for a particular printer to be loaded into a printer main body.

A further object of the invention is to provide an ink cartridge identifying apparatus that can reliably identify the loading of a standard, proper ink cartridge and empirically confirm that a standard, proper ink cartridge has been loaded.

Another object of the invention is to provide an ink cartridge and an ink cartridge identifying apparatus which can increase added value by shaping a projected and recessed pattern portion of the ink cartridge and a pattern matching portion of the ink cartridge identifying apparatus for identifying whether the ink cartridge is a standard, proper ink cartridge, into a pattern consisting of characters/symbols or graphics so that this projected and recessed pattern can serve as an identification as to the type of ink cartridge or the type of printer the ink cartridge is to be used with.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 2 is a partial cross-sectional view showing an ink cartridge identifying apparatus constructed in accordance with the first embodiment of the invention showing the press rod open;

FIG. 2A is a top plan view of a portion of the printer main body constructed in accordance with the invention;

FIG. 3 is a partial enlarged cross-sectional view of FIG. 2 showing the rod closed;

FIGS. 5(*a*)–5(*d*) are plan views showing various electrode patterns for embodiments of the invention;

DETAILED DESCRIPTION OF THE PREFERRED EMBODIMENTS

Figure 1:
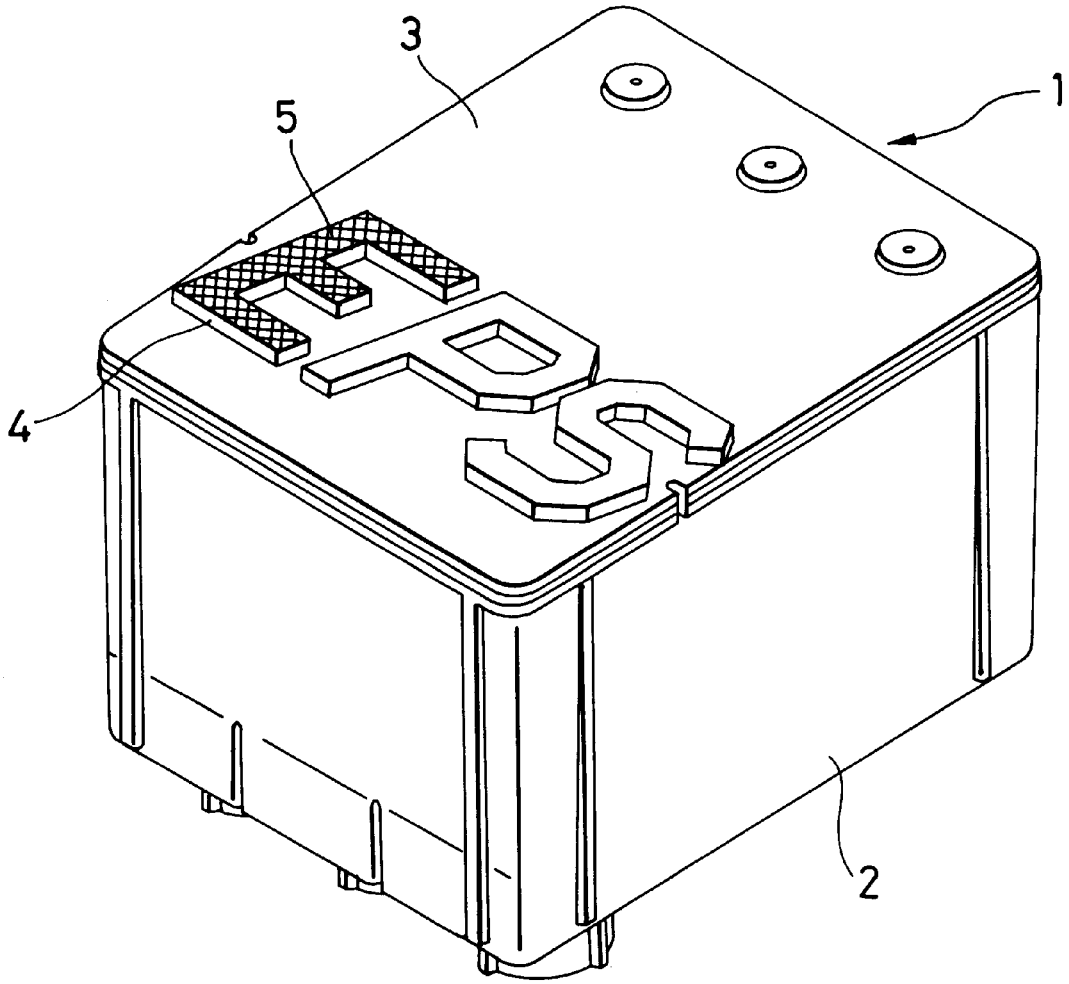
FIG. 1 is a perspective view of an ink cartridge constructed in accordance with a first embodiment of the invention.

Referring first to FIGS. 1, 2 and 3, an ink cartridge 1 includes container 2. A lid 3 is fixed to container 2. A projected and recessed pattern portion 4 is formed on an outside surface of lid 3. A first electrode portion 5 is fixed to projected and recessed pattern portion 4. Projected and recessed pattern portion 4, which in a preferred embodiment may consist of characters, symbols, or the like, is arranged on the upper surface of lid 3. First electrode portion 5 is formed with a predetermined pattern. First electrode portion 5 may be arranged only at selectively specified positions on top of projected and recessed pattern portion 4.

Specific reference is now made to FIG. 2, which shows a printer main body 100 and a receiving slot 110 formed in printer main body 100 for receiving ink cartridge 1. A press frame 120 is hingedly mounted to printer main body 100 via hinge 140 so that press frame 120 can be selectively moved between a first position which opens slot 110 and a second position which closes slot 110. A pattern matching portion 121 is formed on press frame 120 to match the projected and recessed pattern portion 4 arranged on the upper surface of lid 3. A second electrode portion 122 that corresponds first electrode portion 5 is positioned on an inner surface of press frame 120 of cartridge receiving slot 110 of a printer main body 100 and is in registration with first electrode portion 5. Second electrode portion 122 is additionally provided within pattern matching portion 121 on bottom surface 123 of pattern matching portion 121. Second electrode portion 122 is electrically connected to a main switch 131 and also to a display lamp 132 of an electric circuit 130 of printer main body 100.

A standard ink cartridge 1 is formed with a predetermined projected and recessed pattern portion 4 provided thereon. When a standard, proper ink cartridge 1 for a particular printer main body 100 is loaded into receiving slot 110 of printer main body 100 and press frame 120 is closed, pattern matching portion 121 matches and engages with projected and recessed pattern portion 4 and first electrode portion 5 engages second electrode portion 122. Thus, electric circuit 130 is closed and display lamp 132 is illuminated to confirm that a proper, standard ink cartridge 1 has been loaded into receiving slot 110. Since main switch 131 remains closed, the printer is ready to begin a print operation.

However, if an improper, irregular ink cartridge is attempted to be loaded, pattern matching portion 121 will not match the projected and recessed pattern portion 4 and press frame 120 will not be able to properly close. As a result, first and second electrode portions 5 and 122 are not engaged and display lamp 132 is not illuminated, which informs the user that an improper cartridge has been loaded into receiving slot 110. Since printer main body 10 will not allow a print operation to be started, the improper cartridge can be removed safely and no damage will be done to printer main body 100 or any other portion of the printer.

In this embodiment, the display lamp 132 is illuminated when a proper, standard ink cartridge 1 is loaded. On the contrary, it may be modified that the display lamp 132 is illuminated when a improper irregular ink is attempted to be loaded, and the display lamp 132 is not illuminated when a proper, standard ink cartridge is loaded.

Figure 4:
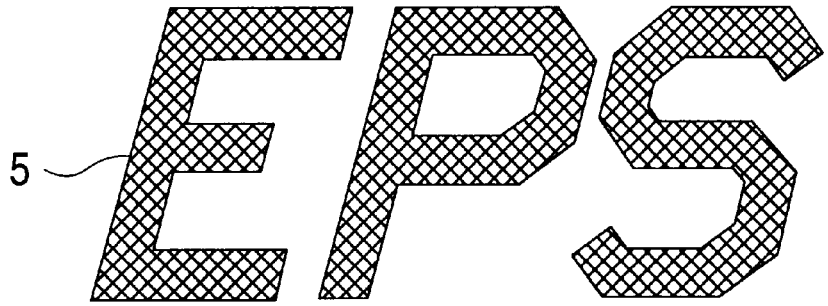
FIGS. 4(*a*)–4(*c*) are plan views depicting various electrode patterns for embodiments of the invention.
Figure 4:
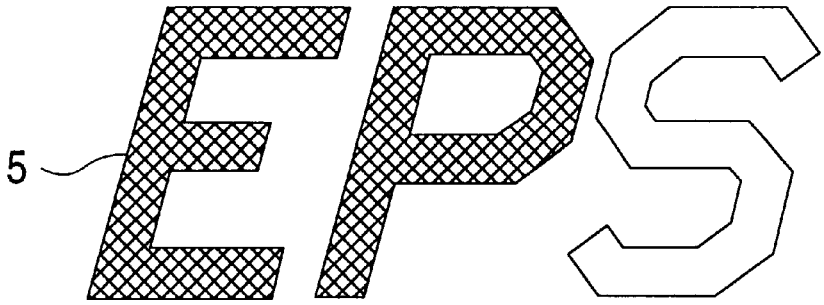
Figure 4:
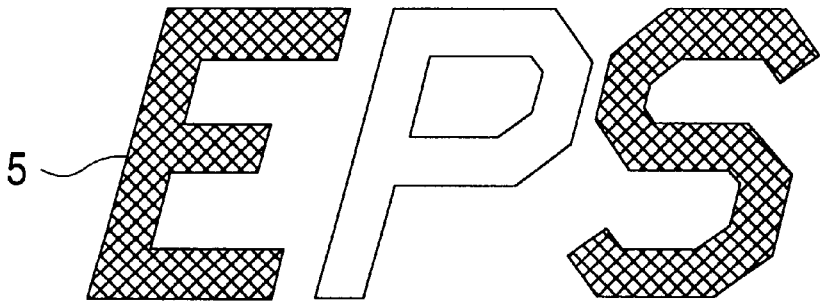

It may be noted that in a preferred embodiment by shaping projected and recessed pattern portion 4 and pattern matching portion 121 into, e.g., a logo such as "EPS" or the like as shown in FIG. 4(*a*), contents of the cartridge, publicity and advertisement or notice of the proper printer with which the cartridge is to be used can be indicated on the cartridge.

In the above embodiment, first electrode 5 and second electrode 122 are disposed on projected and recessed pattern portion 4 and pattern matching portion 121, respectively. Instead, pattern portion 4 and pattern matching portion 121 only may be formed and used for detection of a proper ink cartridge. When a proper ink cartridge is mounted in cartridge slot 110 and press frame 120 is closed, projections and recesses are matched between pattern portion 4 and pattern matching portion 121. On the other hand, when an improper cartridge is mounted, press frame 120 cannot be closed so that the improper cartridge can be detected.

It is also possible to form only the first and second electrodes without forming projections and recesses. In this case, the identification of an proper cartridge can be made by the conductance between the first and second electrodes.

Further, in an additional embodiment, by arranging first and second electrode portions 5 and 122, which are additionally provided on the projected and recessed pattern portion 4 as well as on the pattern matching portion 121, only at selected portions of the pattern shown as shaded portions in FIGS. 4(*a*) to (*c*) and FIGS. 5(*a*) to (*d*), desired conduction between the electrodes can be selectively specified and it is possible to further differentiate between cartridges using the same projected and recessed pattern portions. Thus, by way of example, a common logo could be used on any number of ink cartridges, but by positioning the electrodes only at certain predetermined positions, even though press frame 120 will close on each ink cartridge 1, only the cartridge with the proper arrangement of electrodes will illuminate display lamp 132 and allow the printer to begin a print operation.

By providing an ink cartridge with patterned electrodes thereon, and a matching electrode pattern on the printer body so that contact between electrodes closes a printer circuit, only a standard, proper ink cartridge can be correctly loaded into the printer main body, so that the loading of an irregular ink cartridge can be reliably prevented. Only when a standard, proper ink cartridge has been loaded, the printer main body is operable. By providing an indicator lamp within the circuit, that the printer is in this operable condition can be visibly checked externally by determining if the lamp is illuminated, which in turn allows the user to avoid the use of an improper ink cartridge.

Since the projected and recessed pattern portion and the pattern matching portion may be shaped into characters, symbols, and the like, the projected and recessed pattern portion and the pattern matching portion may themselves be used to serve as an identification of the type of ink cartridge, or the type of printer the ink cartridge is to be used with, or for publicity, advertisement, or the like. It should be noted that the use of electrodes on the lid 3 and frame 121 are by way of example only and that the invention will work if the electrodes are placed on other mating surfaces between slot 110 and cartridge 1.

Figure 6:
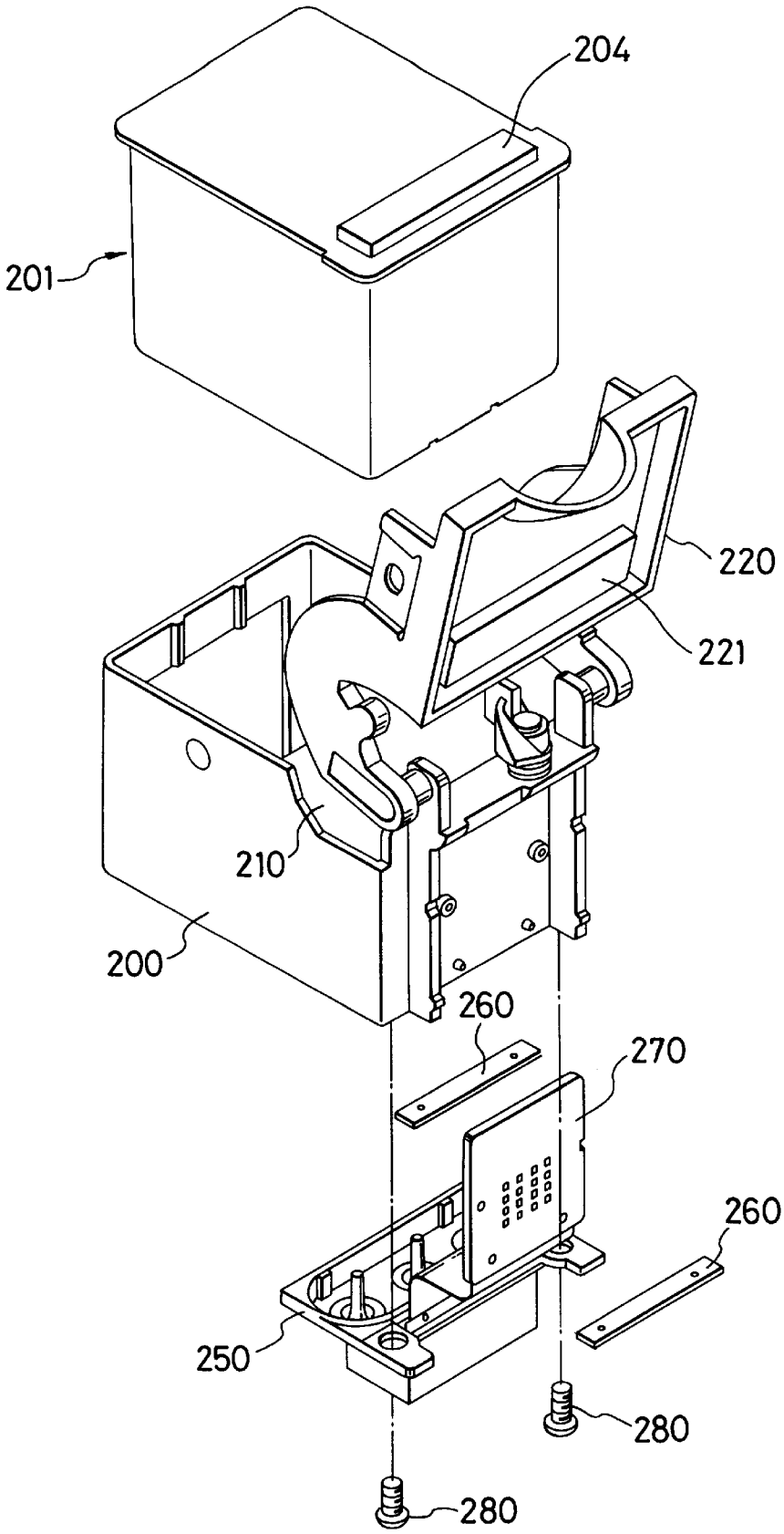
FIG. 6 is a perspective view showing an ink cartridge and a casing according to another embodiment of the present invention.

In the embodiments described above, the ink cartridge 1 is loaded in the receiving slot 110 of the printer main body 100. Instead, a cartridge holder casing 200 being detachable from the printer main body 100 may be used for receiving the ink cartridge 201 of the invention, as shown in FIG. 6. More specifically, the casing 200 has a receiving portion 210 in which the ink cartridge 201 is inserted, a lid 220 pivotably supported by the casing 200 to open or close the upper portion of the receiving portion 210. A head casing 250 is attached to the bottom portion of the casing 200 with screws 280. Packing sheets 260 for sealing are provided between the bottom portion of the casing 200 and the head casing 250. A detecting portion 270 is detected whether the ink cartridge 1 has been inserted or not. More details of the casing having the head casing is shown, for instance Japanese Patent Laid-open No. Hei 8-132634. A standard ink cartridge 1 is formed with a predetermined projected and recessed pattern portion 204 provided thereon. The lid 220 of the casing 200 according to the present invention has a pattern matching portion 221 which matches the projected and recessed pattern portion 204 of the ink cartridge 201. In FIG. 6, the projected and recessed pattern portion 204 and the pattern matching portion 221 are illustrated as rectangular shape for simplification. However, similar to FIG. 4(*a*), the projected and recessed pattern portion 204 and the pattern matching portion 221 may shaped into a logo such as "EPS" or the like.

Furthermore, a first electrode portion may be fixed to projected and recessed pattern portion 204, and a second electrode portion may be formed on an inner surface of lid 220 of receiving portion 210 of the casing 200 in registration with the first electrode portion.

Figure 7:
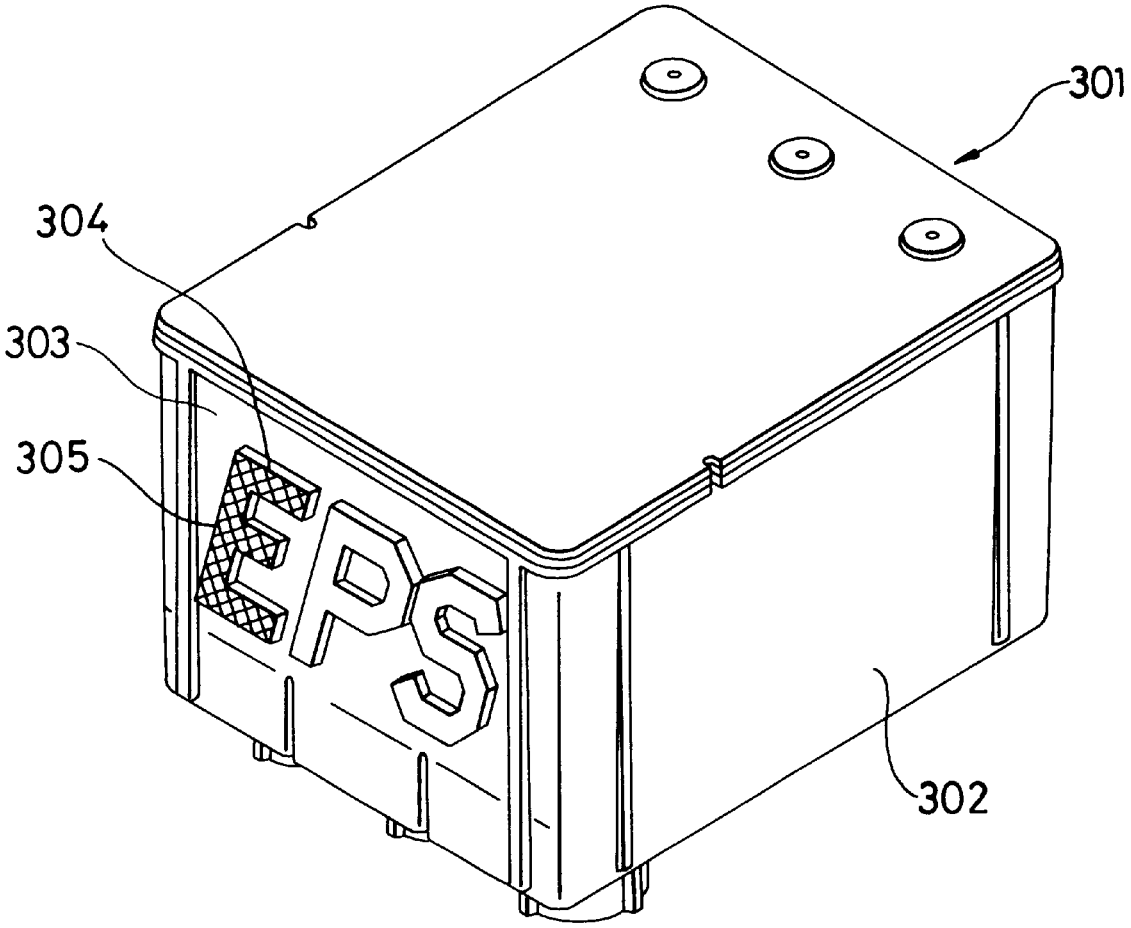
FIG. 7 is a perspective view showing an ink cartridge according to still another embodiment of the invention.
Figure 8:
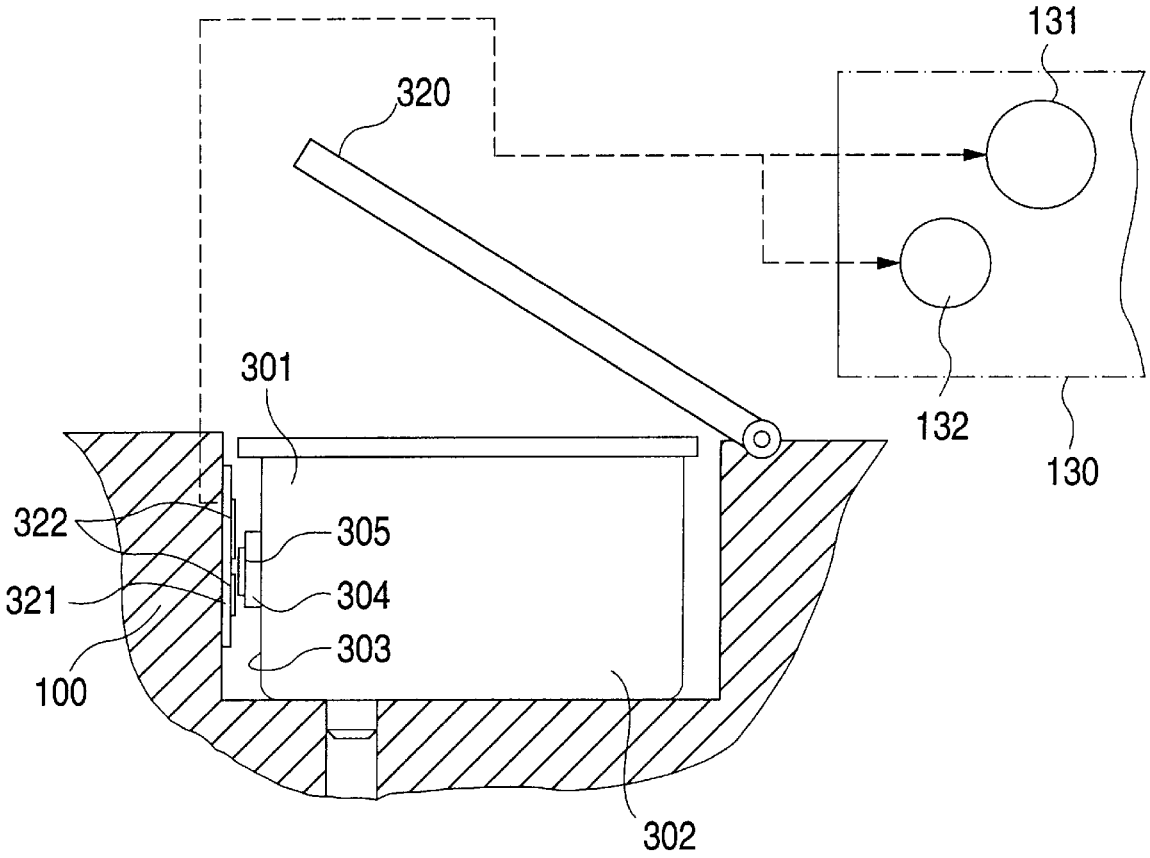
FIG. 8 is a partial cross-sectional view showing an ink cartridge identifying apparatus constructed in accordance with the invention.

FIG. 7 shows still another embodiment of the present invention. A cartridge 301 has a projected and recessed pattern portion 304 at a front wall portion 303 of a container 302 thereof. A first electrode portion 305 is fixed to the projected and recessed pattern portion 304. A pattern matching portion 321 is formed at a side wall of the printer body corresponding to the front wall portion 303 of the container 302, as shown in FIG. 8. A second electrode portion 322 is formed on the pattern matching portion 321. The second electrode portion 322 is electrically connected to a main switch 131 and also to a display lamp 132 of an electric circuit 130 of printer main body 100.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. An ink cartridge for use in a printer main body, comprising:

a container for containing ink therein;

a lid attached to said container;

a projected and recessed pattern portion formed on at least one portion of said container and said lid; and a pattern matching portion formed in said printer main body, said projected and recessed pattern portion matching said pattern matching portion when said ink cartridge is properly mounted in said printer main body;

wherein a first electrode is formed on said recessed and projected portion and a second electrode is formed on said pattern matching portion, said first electrode being electrically connected to said second electrode when said ink cartridge is properly mounted in said printer main body.

2. The ink cartridge of claim 1, wherein said recessed and projected portion forms a pattern corresponding to at least one of characters, symbols, and graphics.

3. An ink cartridge for use in a printer main body, said printer main body having a pattern matching portion, comprising:

a predetermined projected and recessed pattern portion formed on an outer surface of said ink cartridge and a main body pattern matching portion, said predetermined projected and recessed pattern portion coming into contact with, and matching the main body pattern matching portion;

wherein a first electrode is formed on said predetermined projected and recessed pattern portion and a second electrode is formed on said main body pattern matching portion, said first electrode being electrically connected to said second electrode when said ink cartridge is properly mounted in said printer main body.

4. An ink cartridge identification system, comprising:

a printer having a main body;

an ink cartridge;

a projected and recessed pattern portion formed on at least one portion of said ink cartridge; and a pattern matching portion formed in said printer main body to thereby match said projected and recessed pattern portion when said ink cartridge is properly mounted in said printer main body;

wherein a first electrode is formed on said recessed and projected portion and a second electrode is formed on said pattern matching portion, said first electrode being electrically connected to said second electrode when said ink cartridge is properly mounted in said printer main body.

5. An ink cartridge identification system comprising:

a printer having a main body;

an ink cartridge;

a projected and recessed portion formed on at least one portion of said ink cartridge; and a pattern matching portion formed in said printer main body to thereby match said projected and recessed pattern portion when said ink cartridge is properly mounted in said printer main body; p1 a first electrode portion being fixed to said projected and recessed portion;

a second electrode portion being fixed to said pattern matching portion, said second electrode portion selectively coming into contact with said first electrode portion to produce an identification signal when in contact.

6. The ink cartridge identification system of claim 5, wherein said printer is operable when said projected and recessed pattern portion and said pattern matching portion are electrically connected completing an electric circuit.

7. The ink cartridge identification system of claim 6, wherein further comprising a display lamp electrically coupled to said pattern matching portion, said display lamp being illuminated when said printer is operable.

8. An ink cartridge identification system, comprising:

an ink cartridge;

a first electrode portion disposed on said ink cartridge;

a printer main body dimensioned to receive said ink cartridge;

a second electrode portion disposed on said printer main body, said second electrode portion selectively coming into contact with said first electrode to produce an identification signal when in contact;

a first recessed and projecting portion formed on said ink cartridge, said first electrode portion being fixed to said first recessed and projecting portion; and a second recessed and projecting portion formed on said printer main body, said second electrode portion being fixed to said second recessed and projecting portion.

9. An ink cartridge identification system, comprising:

a printer having a main body;

a first recessed and projecting portion fixed to said printer main body;

a first electrode portion fixed to said first recessed and projecting portion;

an ink cartridge dimensioned to be selectively loaded into said printer main body;

a second recessed and projecting portion fixed to said ink cartridge, said second recessed and projecting portion being selectively engageable with said first recessed and projecting portion; and a second electrode portion fixed to said second recessed and projecting portion, said second electrode portion being selectively engageable with said first electrode portion.

10. The ink cartridge identification apparatus of claim 9, wherein said printer is operable when said first and said second electrode portions are engaged completing an electric circuit.

11. The ink cartridge identification system of claim 10, further comprising:

a display lamp electrically coupled to said second electrode portion which is illuminated when said printer is operable.

12. The ink cartridge identification system of claim 9, wherein said first recessed and projected portion forms a pattern corresponding to at least one of characters, symbols and graphics.

* * * * *